US008614619B2

(12) United States Patent
Levi

(10) Patent No.: US 8,614,619 B2
(45) Date of Patent: Dec. 24, 2013

(54) FUSE HOLDER, PARTICULARLY FOR INTERLOCKED SOCKETS AND ELECTRICAL APPARATUSES IN GENERAL

(75) Inventor: Bruno Levi, Brescia (IT)

(73) Assignee: Palazzoli S.p.A., Brescia (IT)

( * ) Notice: Subject to any disclaimer, the term of this patent is extended or adjusted under 35 U.S.C. 154(b) by 227 days.

(21) Appl. No.: 13/258,299

(22) PCT Filed: Apr. 15, 2010

(86) PCT No.: PCT/EP2010/002316

§ 371 (c)(1),
(2), (4) Date: Sep. 21, 2011

(87) PCT Pub. No.: WO2010/118871

PCT Pub. Date: Oct. 21, 2010

(65) Prior Publication Data

US 2012/0019346 A1 Jan. 26, 2012

(30) Foreign Application Priority Data

Apr. 17, 2009 (IT) ..... MI2009A0634

(51) Int. Cl.
*H01H 85/50* (2006.01)

(52) U.S. Cl.
USPC ..... 337/214; 337/186; 337/207; 337/208; 337/209; 337/255; 337/260; 337/263

(58) Field of Classification Search
USPC ..... 337/214, 186, 207–209, 255, 260, 263
See application file for complete search history.

(56) References Cited

U.S. PATENT DOCUMENTS

| | | | | |
|---|---|---|---|---|
| 2,186,813 | A * | 1/1940 | Adam et al. | 337/210 |
| 2,989,610 | A * | 6/1961 | Linton | 337/206 |
| 3,009,039 | A * | 11/1961 | Scott, Jr. | 337/6 |
| 3,202,788 | A * | 8/1965 | George | 337/194 |
| 4,508,413 | A * | 4/1985 | Bailey | 439/550 |
| 4,762,510 | A * | 8/1988 | Schaefer | 439/620.28 |
| 4,966,561 | A * | 10/1990 | Norden | 439/620.34 |
| 5,002,505 | A * | 3/1991 | Jones et al. | 439/620.29 |
| 5,150,094 | A * | 9/1992 | Babini | 337/214 |
| 5,561,409 | A * | 10/1996 | Rapp et al. | 337/186 |
| 5,859,580 | A * | 1/1999 | Hashizawa et al. | 337/260 |
| 5,969,587 | A * | 10/1999 | Combas | 335/132 |
| 6,101,079 | A | 8/2000 | Viklund | |
| 6,366,449 | B1 * | 4/2002 | Hashizawa et al. | 361/642 |
| 6,459,353 | B1 * | 10/2002 | Mattlar et al. | 337/9 |
| 6,650,222 | B2 * | 11/2003 | Darr et al. | 337/187 |

(Continued)

FOREIGN PATENT DOCUMENTS

| | | |
|---|---|---|
| EP | 1 381 068 A1 | 1/2004 |
| RU | 2112299 C1 | 5/1998 |

(Continued)

*Primary Examiner* — Anatoly Vortman
(74) *Attorney, Agent, or Firm* — R. Neil Sudol; Coleman Sudol Sapone, P.C.

(57) ABSTRACT

A fuse holder, particularly for interlocked sockets and electrical apparatuses in general, includes a tray which is inserted in a seat and is adapted to accommodate a fuse. The tray is movable along a rectilinear path, having at least two positions: an active position, in which the fuse is active, and an extracted position, in which the fuse can be removed from the tray. The seat includes two elastic contact members which provide an electrical and mechanical connection of the fuse in the active position.

5 Claims, 10 Drawing Sheets

(56) References Cited

U.S. PATENT DOCUMENTS

| | | | | |
|---|---|---|---|---|
| 6,727,797 | B1 * | 4/2004 | Bruchmann | 337/210 |
| 7,893,809 | B2 * | 2/2011 | Head | 337/194 |
| 7,982,578 | B2 * | 7/2011 | Buettner | 337/196 |
| 8,080,752 | B2 * | 12/2011 | Levi | 200/316 |
| 8,419,475 | B2 * | 4/2013 | von zur Muehlen | 439/620.26 |
| 2002/0044038 | A1 | 4/2002 | Andoh et al. | |
| 2012/0105239 | A1 * | 5/2012 | Levi | 340/638 |
| 2013/0114177 | A1 * | 5/2013 | Mosesian et al. | 361/88 |

FOREIGN PATENT DOCUMENTS

| | | | |
|---|---|---|---|
| RU | 2222071 | C2 | 1/2004 |
| SU | 64208 | A1 | 1/1945 |
| SU | 997126 | A1 | 2/1983 |
| SU | 1078490 | A1 | 3/1984 |
| SU | 886092 | A1 | 11/1998 |

* cited by examiner

FUSE HOLDER, PARTICULARLY FOR INTERLOCKED SOCKETS AND ELECTRICAL APPARATUSES IN GENERAL

This application claims the priority of Italian Patent Application No. MI2009A000634, filed on Apr. 17, 2009, the subject matter of which is incorporated herein by reference.

BACKGROUND OF THE INVENTION

The present invention relates to a fuse holder particularly for interlocked sockets and electrical apparatuses in general.

As is known, interlocked sockets incorporate mechanical or electrical locking devices which are connected to interruption devices, generally constituted by rotary switching apparatuses, in order to ensure that a plug cannot be inserted or extracted in the presence of power.

Interlocked sockets are also provided with protective fuses in order to ensure the safety of the operators and the integrity of all apparatuses.

The fuses are inserted in adapted seats which are generally constituted by tilting members.

In order to replace a fuse it is necessary to extract the fuse with one's fingers from the tilting member after opening the member.

This operation is not always easy and in any case entails that the user inserts his fingers in a recess that is very close to electrical contacts.

U.S. Pat. No. 6,101,079 discloses a current and transient voltage protector, for use in the communication industry, having a plurality of fuse holders each holding a fuse between two contact lines.

OBJECTS OF THE INVENTION

The aim of the present invention is to provide a new type of fuse holder that allows easier and safer fuse replacement than conventional systems.

An object of the invention is to provide a fuse holder that is constructively simple and allows to reduce the production cost of the electrical apparatus in which it is installed.

A further object of the invention is to provide a fuse holder that is versatile and can be applied to different apparatuses.

A further object of the present invention is to provide a structure which, by virtue of its particular constructive characteristics, is capable of giving the greatest assurances of reliability and safety in use.

SUMMARY OF THE INVENTION

This aim and these and other objects that will become better apparent hereinafter are achieved by a fuse holder, particularly for interlocked sockets and electrical apparatuses in general, as claimed in the appended claims.

BRIEF DESCRIPTION OF THE DRAWINGS

Further characteristics and advantages will become better apparent from the description of preferred but not exclusive embodiments of the invention, illustrated by way of non-limiting example in the accompanying drawings, wherein.

DETAILED DESCRIPTION

Figure 1:
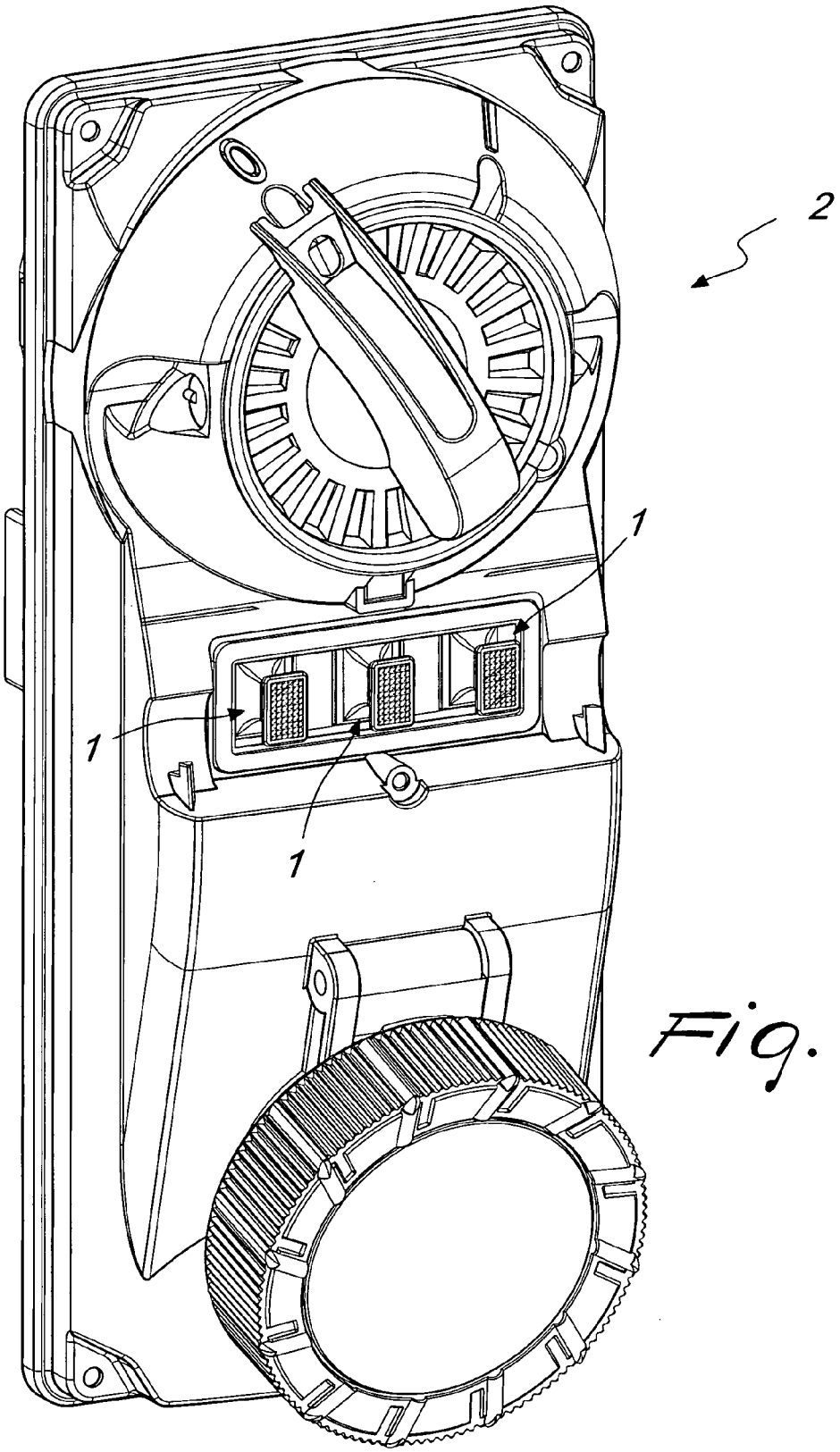
FIG. 1 is a perspective view of an interlocked socket provided with the fuse holder according to the present invention.
Figure 2:
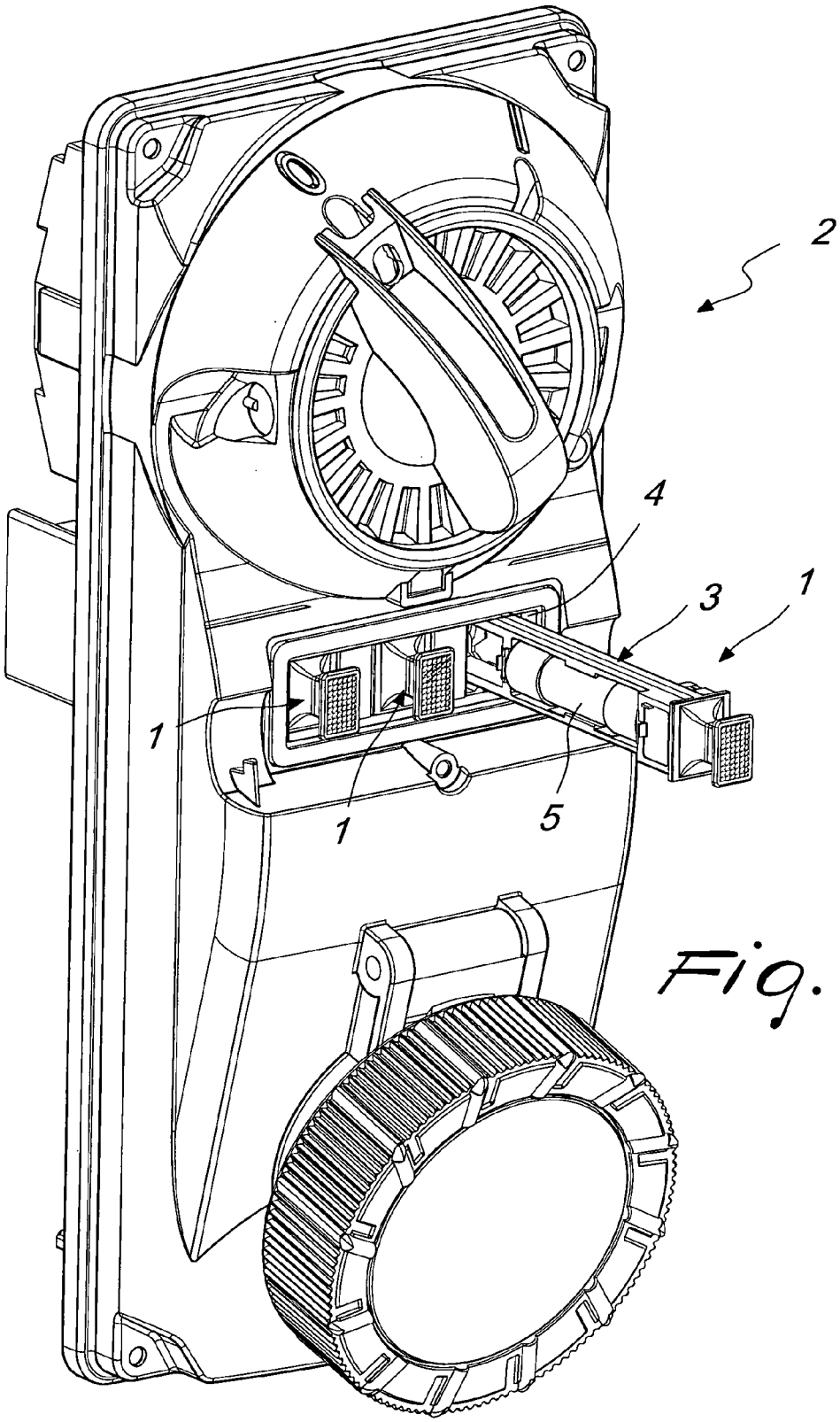
FIG. 2 is a perspective view of the interlocked socket illustrating the fuse holder tray in the open position.
Figure 3:
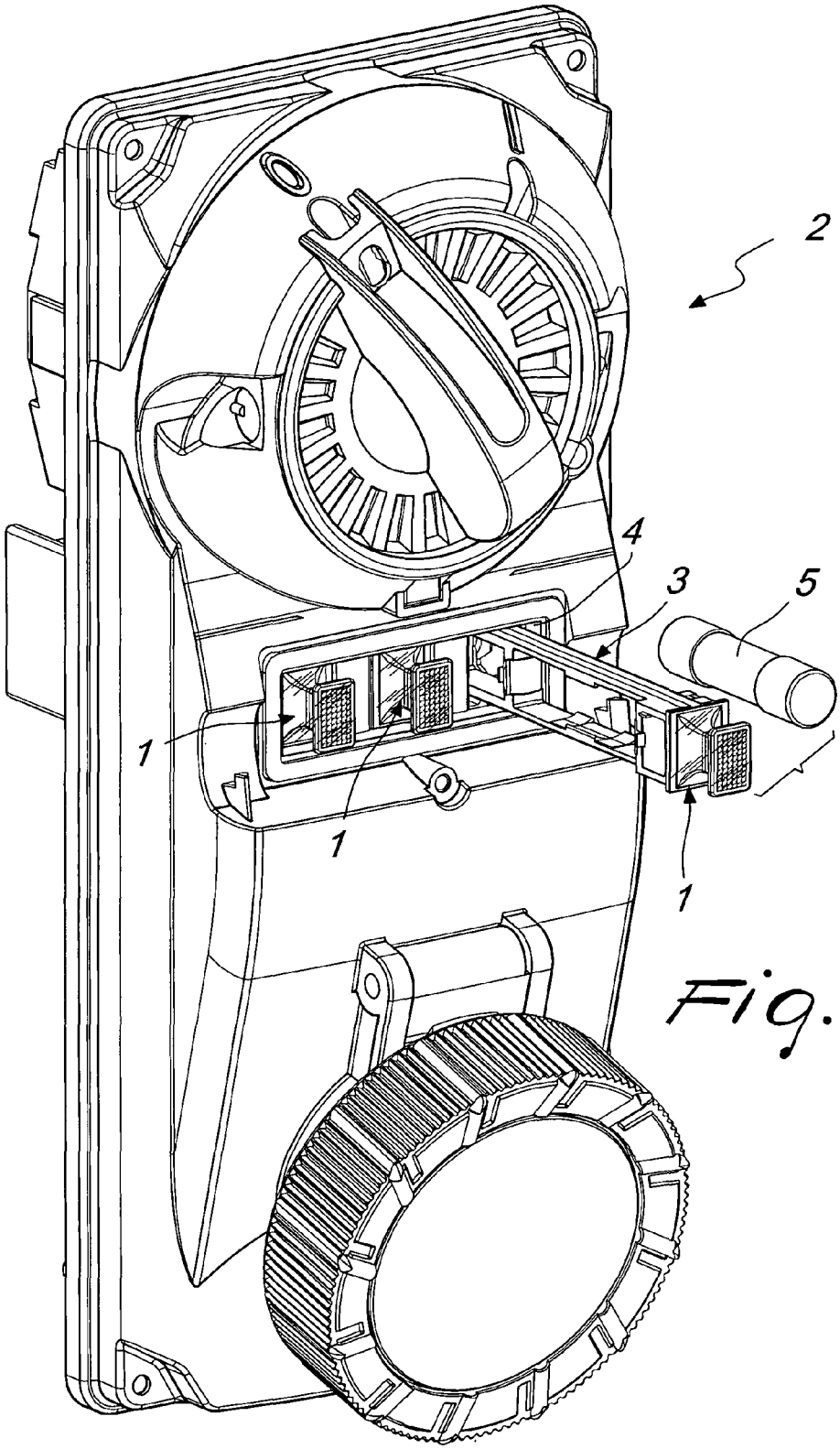
FIG. 3 is a perspective view of the interlocked socket, illustrating the fuse holder tray in the open position with the fuse extracted.
Figure 4:
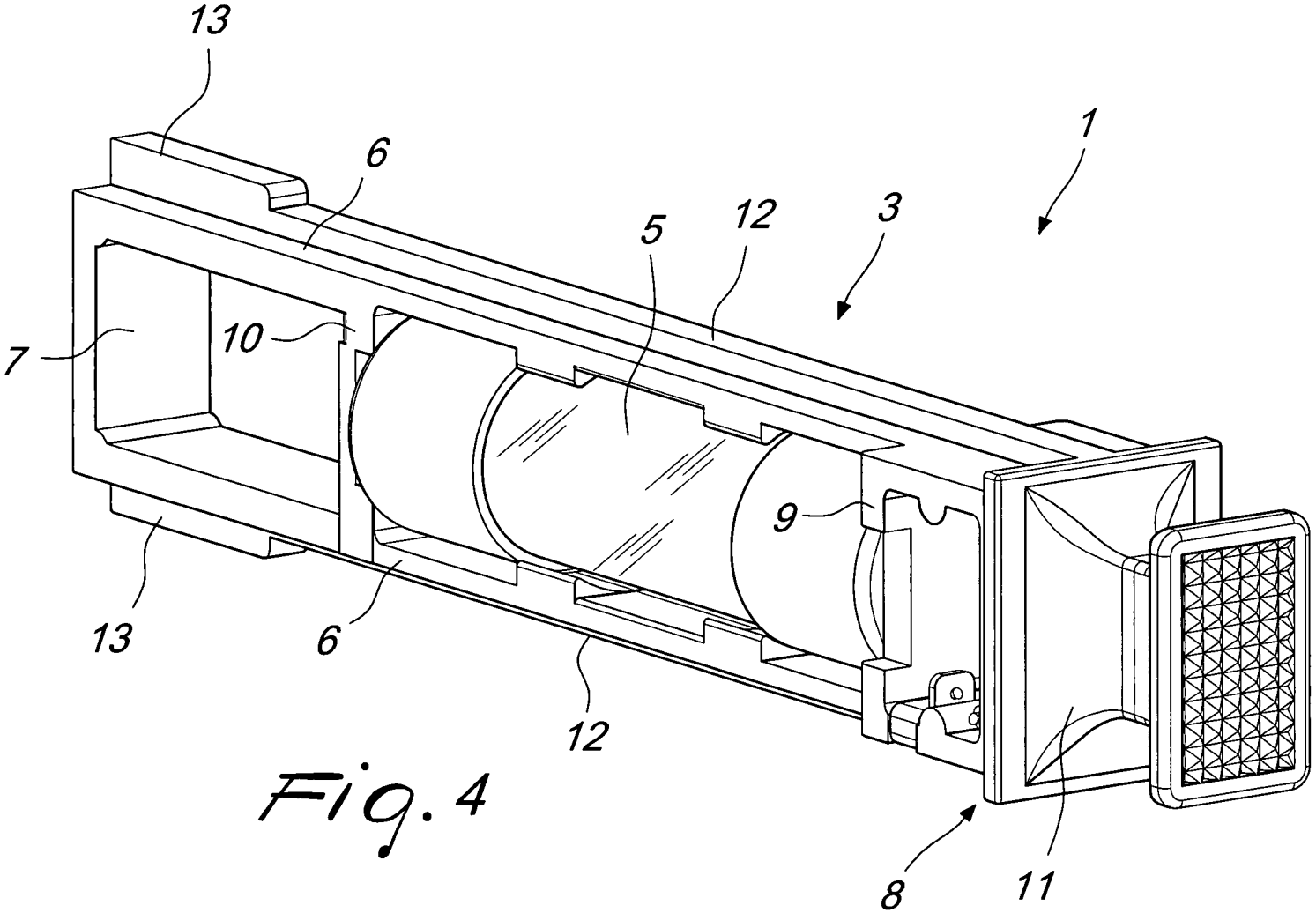
FIG. 4 is a perspective view of the fuse holder tray with the fuse inserted.
Figure 5:
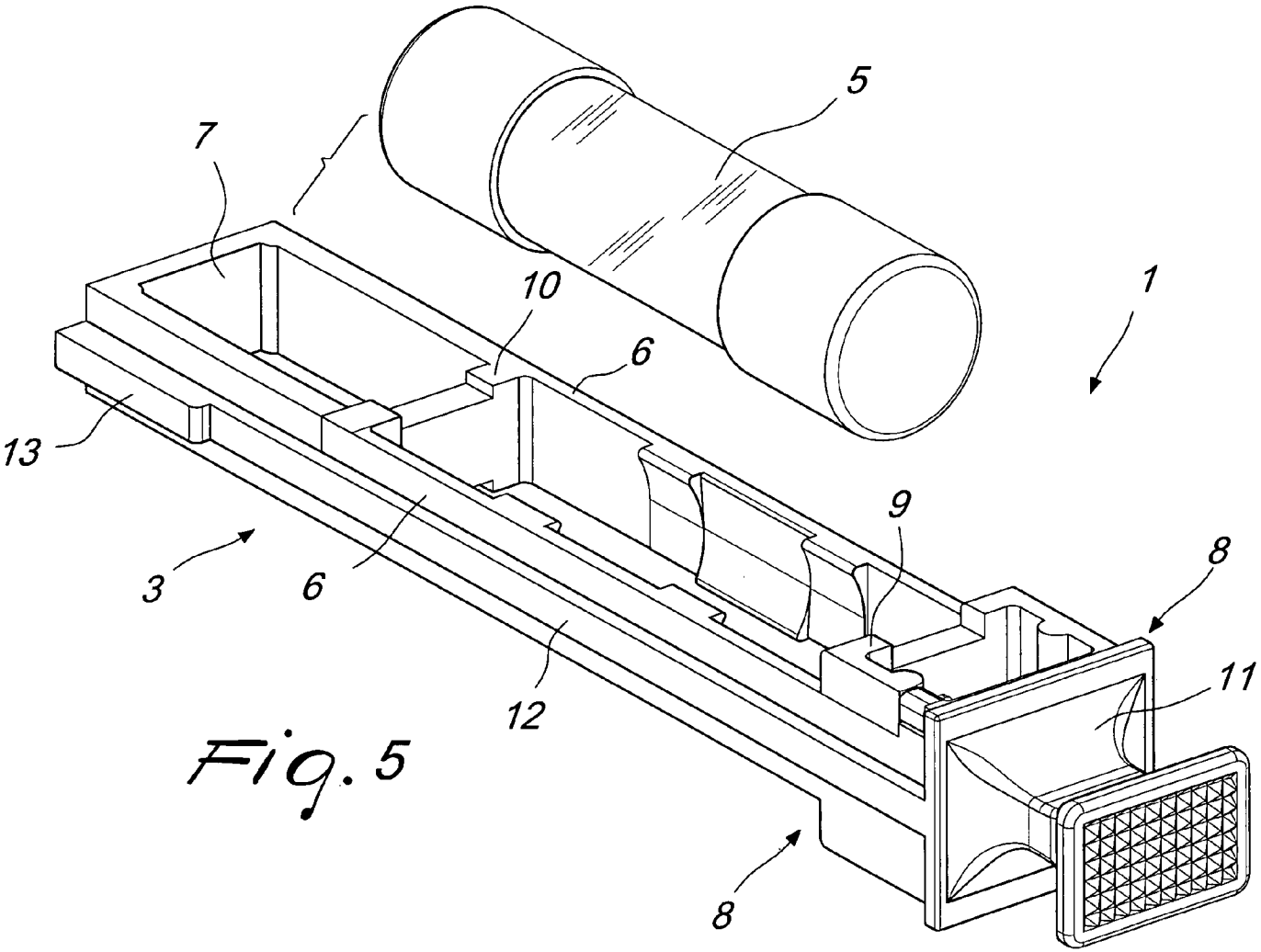
FIG. 5 is a perspective view of the fuse holder tray with the fuse extracted.
Figure 6:
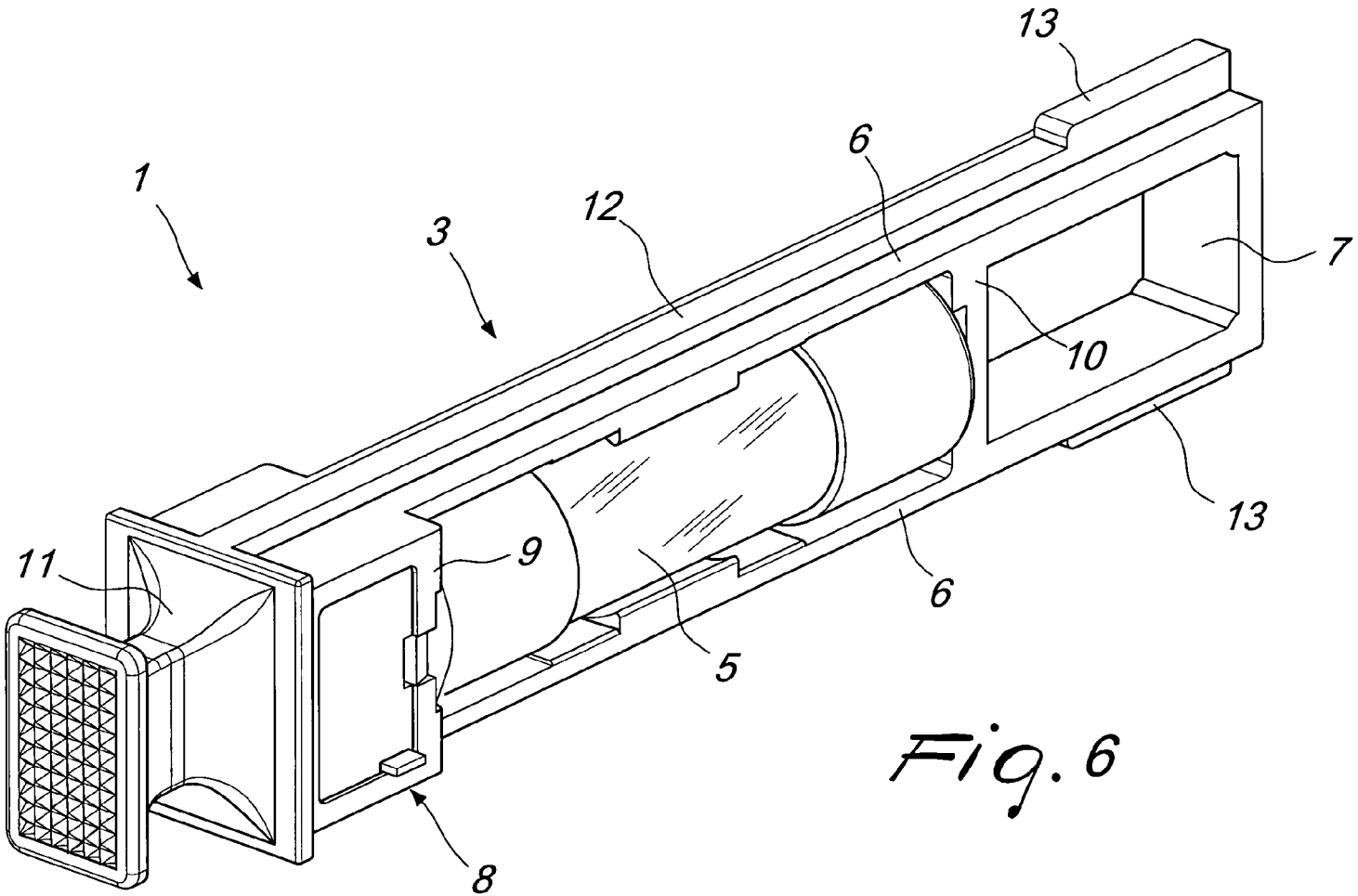
FIG. 6 is another perspective view of the fuse holder tray with the fuse inserted.
Figure 7:
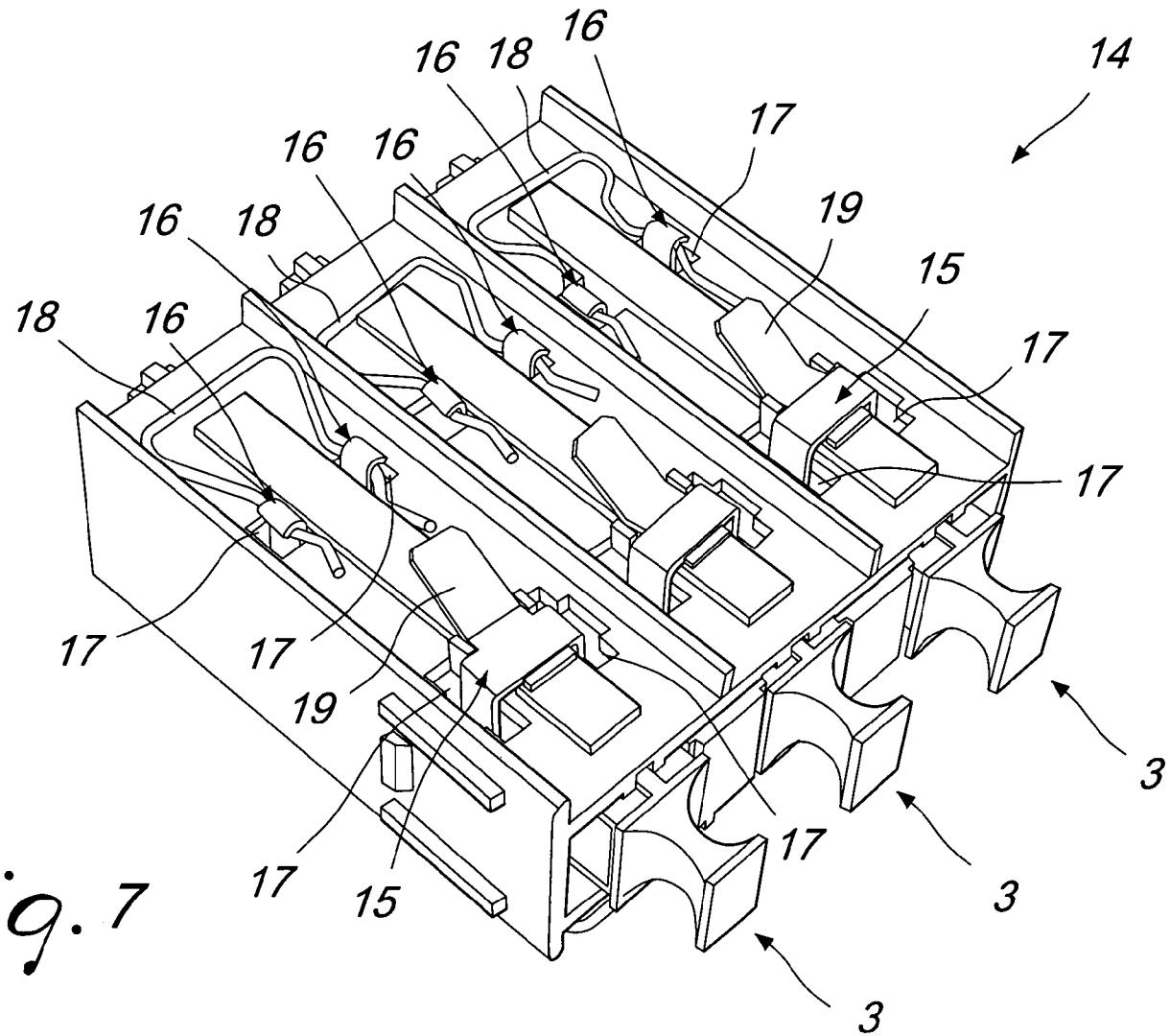
FIG. 7 is a perspective view of the containment structure of the fuse holder trays.
Figure 8:
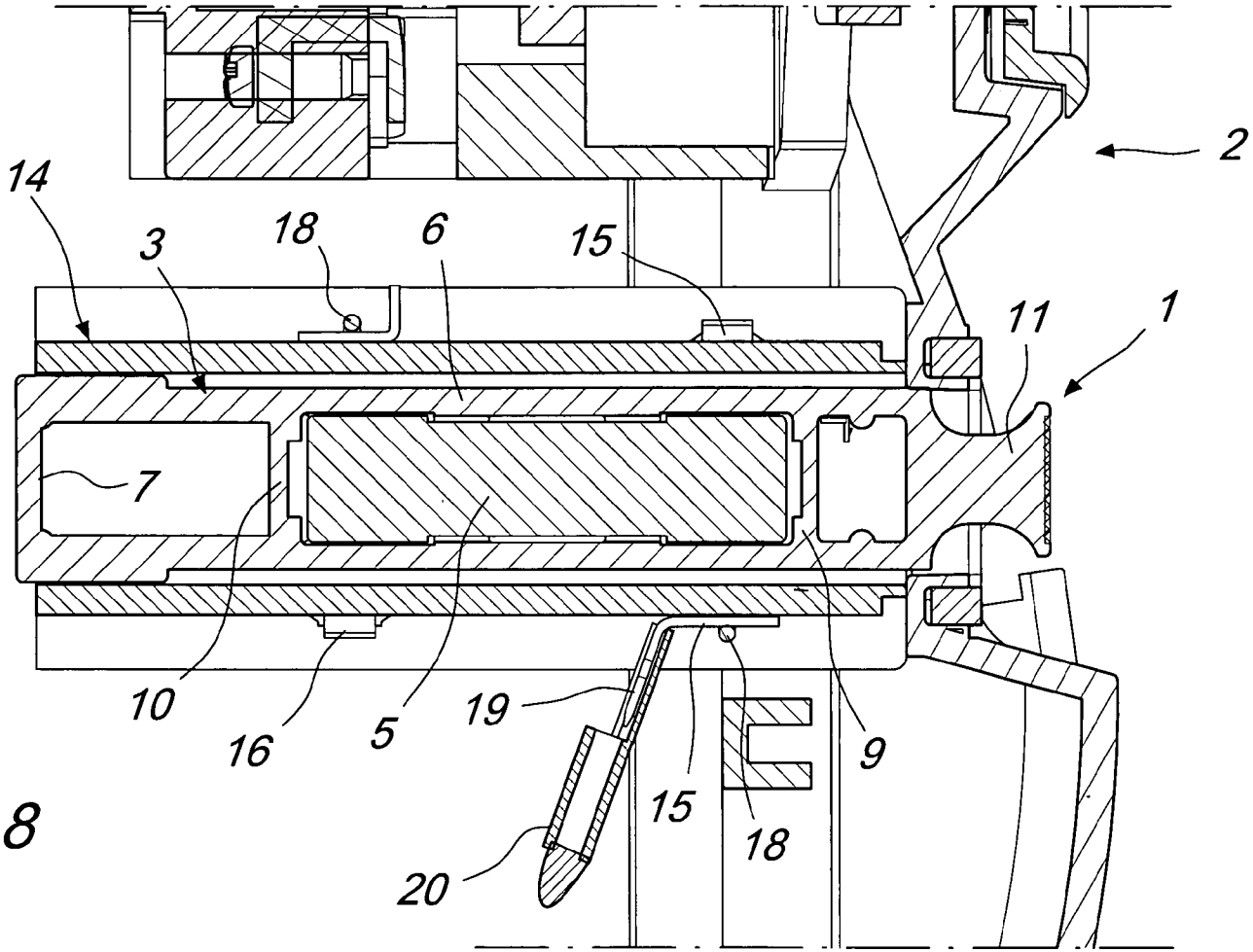
FIG. 8 is a sectional side view of the interlocked socket portion that contains the fuse holder according to the present invention.
Figure 9:
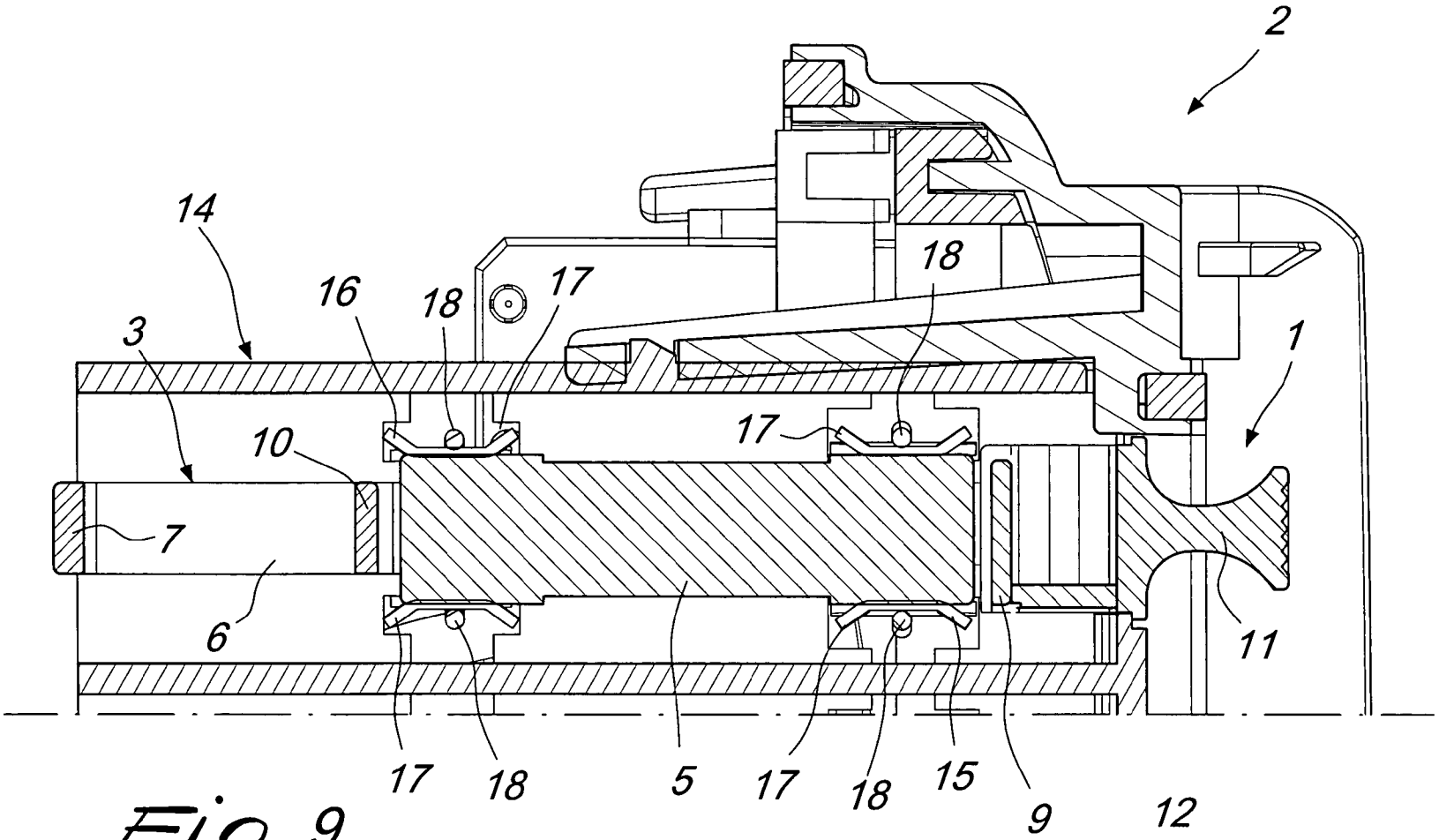
FIG. 9 is a sectional plan view of the interlocked socket portion that contains the fuse holder according to the present invention.
Figure 10:
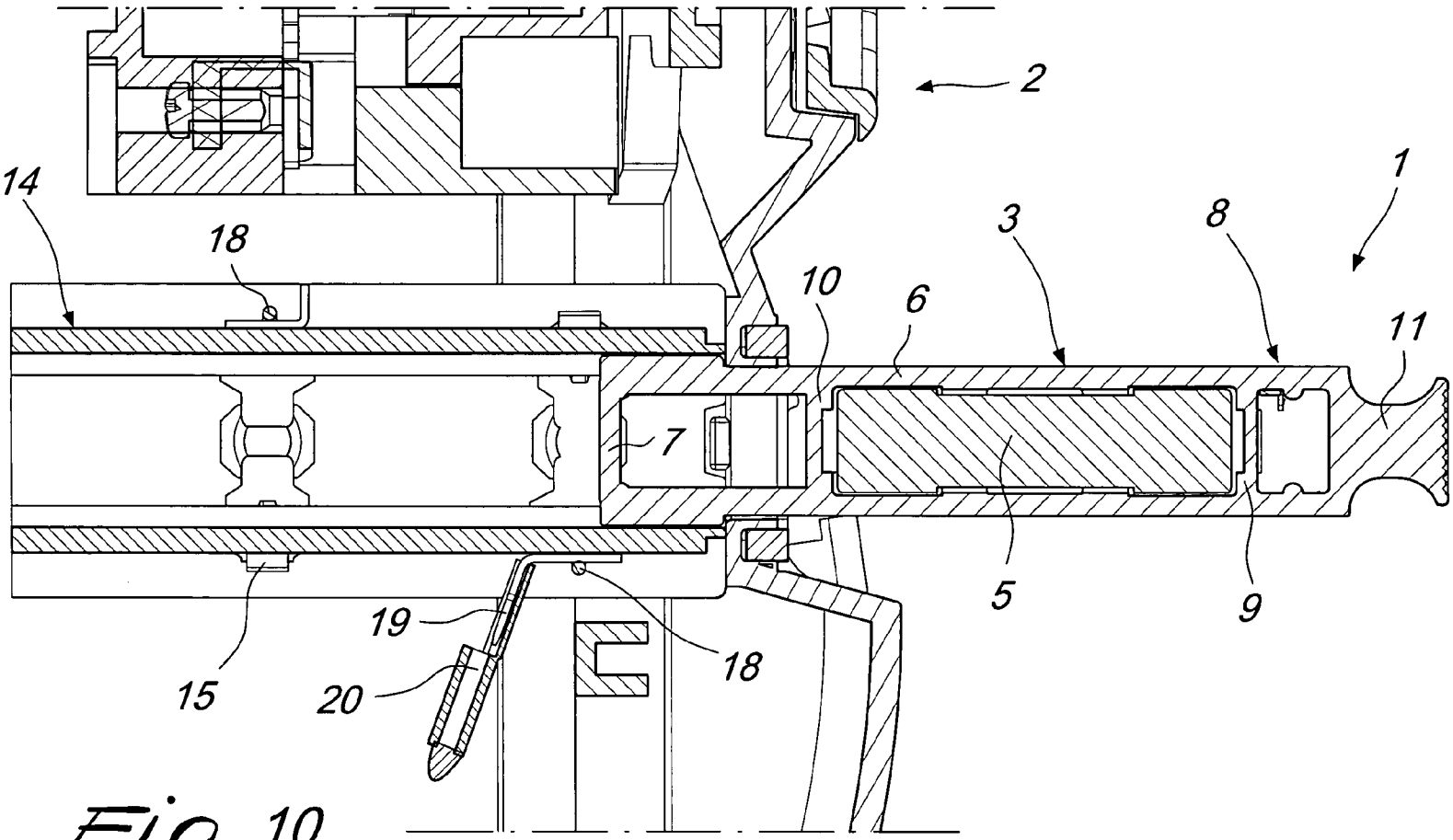
FIG. 10 is a sectional side view, similar to FIG. 8, of the interlocked socket portion that contains the fuse holder according to the present invention, wherein the fuse holder tray is shown in the position in which it is extracted from its seat.

With reference to the cited figures, the fuse holder according to the invention, generally designated by the reference numeral 1, is shown applied to an interlocked socket, generally designated by the reference numeral 2.

In the specific case, the interlocked socket has three fuse holders for a corresponding number of fuses.

The fuse holder has a tray 3 which is inserted in a seat 4 and is adapted to accommodate a fuse 5.

The invention claimed is:

1. A fuse holder, particularly for interlocked sockets and electrical apparatuses in general, comprising a tray which is inserted in a seat and accommodates a fuse; said tray being movable along a rectilinear path, defining at least two positions: an active position, in which said fuse is active, and an extracted position, in which said fuse can be removed from said tray; said seat comprising two elastic contact members which provide an electrical and mechanical connection of said fuse in said active position; said seat being formed in a containment structure that is arranged within a body of an electrical apparatus; said containment structure comprising a pair of blades bent into a U-shape: a front blade and a rear blade; each blade being constituted by a pair of contoured wings connected by a base which has a tab for connection to a connector; said contoured wings being inserted in slots provided in said containment structure so that said contoured wings wrap around said tray in positions that coincide with terminals of the fuse; said blades being kept in position by wire springs, which engage free ends of said contoured wings of each blade when said tray is in said active position, said contoured wings of the blades wrapping around the terminals of the fuse, providing an electrical and mechanical connection.

2. The fuse holder according to claim 1, wherein said tray is constituted by a frame which comprises a pair of longitudinal members joined by a bottom, a front portion and an intermediate post; said front portion comprising an internal partition and a grip member that extends externally.

3. The fuse holder according to claim 2, wherein each of said longitudinal members comprises a longitudinal protrusion that ends with an enlarged portion at the rear; said protrusion engaging a respective slot formed in said seat in order to guide a rectilinear movement of said tray.

4. The fuse holder according to claim 1, wherein said seat in which said tray is inserted is formed in a containment structure that is arranged in a body of an interlocked socket.

5. The fuse holder according to claim 4, wherein said containment structure has one or more seats for a corresponding number of respective trays.

* * * * *